United States Patent [19]

Lewkovich

[11] Patent Number: 5,050,875

[45] Date of Patent: Sep. 24, 1991

[54] ABDOMINAL EXERCISING DEVICE

[76] Inventor: Gary N. Lewkovich, 656 Matagual, Vista, Calif. 92083

[21] Appl. No.: 525,256

[22] Filed: May 17, 1990

[51] Int. Cl.[5] ..... A63B 21/02

[52] U.S. Cl. ..... 272/137; 272/68

[58] Field of Search ..... 297/460; 132/7 R, 82 R, 132/295; 272/137, DIG. 5, 93, 99, 135, 136, 139, 140, 141

[56] References Cited

U.S. PATENT DOCUMENTS

| | | | |
|---|---|---|---|
| 3,497,216 | 2/1970 | Feather | 272/137 |
| 4,679,576 | 7/1987 | Yuhara | 132/293 |
| 4,815,608 | 3/1989 | Silberberg | 132/295 |

FOREIGN PATENT DOCUMENTS

| | | | |
|---|---|---|---|
| 0046892 | 10/1982 | Japan | 297/460 |

*Primary Examiner*—Stephen R. Crow

*Assistant Examiner*—Jerome Donnelly

[57] ABSTRACT

An abdominal exerciser (20) having a relatively flat base member (60) and a centrally contoured outer member (70) with a sufficeint recess to receive the bony protuberances of the user's spine on one method of operation and the fingertips of both hands in a second method of operation. The members are pivotally connected at one end and a V-shaped opening can be formed at the opposite end by disposing a pivotally moving spring (40) between the members. Additionally, in one embodiment, a resistance measuring gauge (50) can be attached to the base member (60) and positioned through a hole (128) in the centrally contoured outer member (70). The user directly exercises the abdominal muscles by forcing the members together against the resistance of the spring (40) when the device is used either fixed betwen a stable surface and the low back, or fixed between the abdominal region and the grip of both hands.

19 Claims, 4 Drawing Sheets

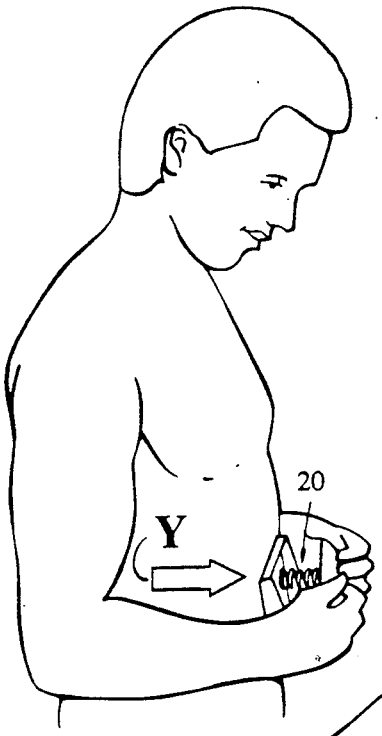
FIG.10
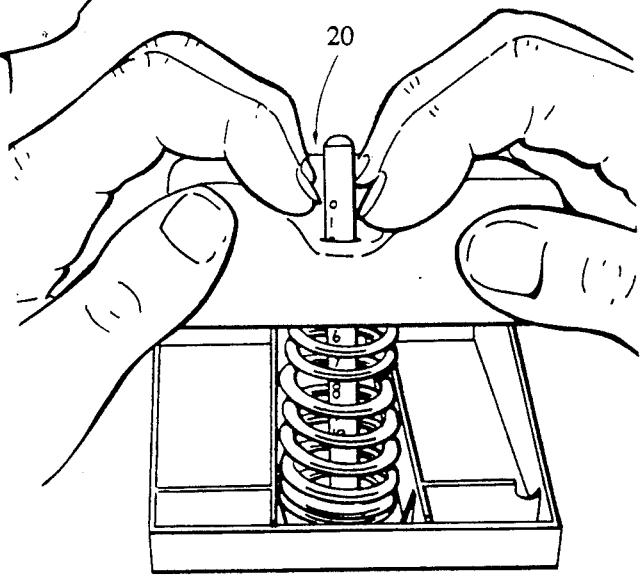
FIG.11
FIG.12
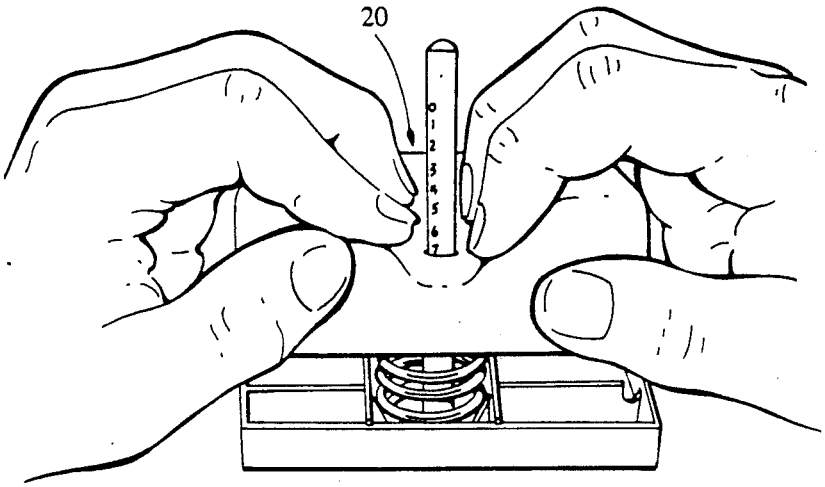

ABDOMINAL EXERCISING DEVICE

BACKGROUND

1. Field of Invention

This invention relates in general to physical exercise devices. Specifically it relates to devices for exercising the abdominal muscles.

2. Discussion of Prior Art

A firm, flat abdomen is generally considered aesthetically pleasing and is often associated with a healthier low back. There have been a variety of exercise devices designed for achieving a firmer, flatter abdomen, but few remain in general use. Those abdominal exercisers that are still utilized often fail to achieve their goal or actually aggravate the low back and/or neck in the process of attempting to achieve their goal. Additional reasons for failure to utilize the variety of abdominal devices purporting to firm and flatten the abdomen include their inconvenience to use, lack of comfort when utilizing, their relatively high cost, their lack of a means to measure resistance, their lack of easy portability, their inability to use in a variety of convenient postures or positions, and their inability to utilize with appropriate spinal movement.

ABDOMINALLY APPLIED DEVICES UTILIZING SPRING RESISTANCE

A variety of abdominal exercise devices have been proposed that include a spring, or a plurality of springs, as the method of providing the resistance.

Two early devices for exercising the abdomen utilize springs that are sufficiently large and powerful enough so as to be able to support the user's entire body weight. U.S. Pat. No. 1,548,849 to Ruden (1925) discloses a multipurpose exercise device with a plurality of spring loaded pads, one of which is adapted to exercise the abdominal region by the outward pressure of the abdominal muscles. U.S. Pat. No. 2,494,094 to Horstman (1950) shows an upright coil spring between a supporting base and an abdominal contacting pad, on which the user lies and exerts a downward pushing action with the abdominal muscles. Both of these devices employ relatively large springs, with contacting pads that are nearly the width of the user's torso. Thus, the machines are not conveniently portable and are expensive to manufacture.

Three abdominal exercising devices which attach to the user's torso and employ spring resistance have been proposed. U.S. Pat. No. 3,278,185 to Bidopia and Ebner (1966) describes a device that looks like a larger than usual rectangular belt buckle, attached to the user's waist by a belt, which resists expansion of the abdominal muscles. U.S. Pat. No. 3,532,340 to Nardiello (1970) shows an abdominal exercise device with several springs that run from a hoop-like outer ring to a body-attached inner belt. U.S. Pat. No. 4,775,148 to McLaughlin (1988) shows a belt-attached abdominal exercising device that utilizes a coiled spring between a fixed retaining plate and a plate that contacts the abdominal wall. All three devices, due to their body-attached design, are prone to cause skin chafing when used. Additionally, all three devices are inconvenient to utilize because the user must first strap the device on before exercising and then remove it when finished. The latter two devices provide no resistance measurement device and are too large to fit in a coat pocket.

One hand-held abdominal exercising device with spring resistance has been proposed. U.S. Pat. No. 3,228,392 to Speyer (1966) describes a circular cushioned pad that is held against the abdomen using a double handgrip mechanism and an intervening cylinder with a spring. This device has the disadvantages of being too large to fit in a briefcase or coat pocket, has no resistance measuring gauge, and can only work the abdomen by a protrusion-like exertion of the abdominal muscles, rather than being capable of also working these muscles with a retraction-like effort.

Proposed is a device, reportedly patent pending, to Van Der Hoeven which is a hand-held, abdominally applied exerciser that employs a resilient cord in place of spring resistance. This device is similar to U.S. Pat. No. 3,228,392 to Speyer (1966) and has the same disadvantages of being too large to fit in a coat pocket and can only exercise the abdomen by a protrusion-like exertion of the abdominal muscles.

Disadvantages of Abdominally Applied Devices

All of the above-referenced devices exercise the abdominal region by relying on the outward pushing of the abdominal muscles against some method of resistance. While this method may provide an effective manner of abdominal exercise, it is definitely not the method of choice for many individuals. The method of exercising one's abdomen by the forceful outward protrusion of the abdominal muscles is often inappropriate for pregnant women and those people with abdominal aneurysms and certain types of hernias. The considerable external pressures on the abdomen that can be generated when utilizing these types of exercise machines may increase the likelihood of spontaneous abortion and may over-stress the already weakened arterial wall of an abdominal aneurysm. The outward pushing itself may cause further protrusion of tissues through the weakened site of an abdominal and inguinal hernia.

Structurally Related Devices

Four other spring compression devices are discussed not because they are suited for directly applied abdominal use but because they utilize a generally wedge-like shape with a hinge at one end. U.S. Pat. No. 3,497,216 to Feather (1970), U.S. Pat. No. 4,111,416 to Jinotti (1978), U.S. Pat. No. 4,279,415 to Katz (1981), and U.S. Pat. No. 4,756,522 to Sandoval (1988) are primarily designed for bust development, leg exercise, simulated jogging, and chest exercise, respectively. Each of these patents describe devices with at least two relatively planar but contoured surfaces, that distribute the spring resistance as these surfaces are forced together. Besides not being structurally adapted for safe use with direct abdominal application, all three devices have the disadvantages of having no resistance measuring gauge, which is helpful in monitoring both effort and progress, and lack any suitable adaptation for use if directly applied to the low back.

OBJECTS AND ADVANTAGES

Accordingly, several objects and advantages of my invention are:

Relative to Safety (a) to provide an abdominal exercise device that is relatively easy and safe to utilize by persons of almost any age group;

(b) to provide an abdominal exercise device that can effectively work the abdominal muscles while protecting the low back and neck structures so often abused by the performance of typical sit-ups;

(c) to provide an abdominal exercise device that can effectively exercise the abdominal muscles while minimizing the involvement of the hip flexor muscle groups, so as to avoid possible low back complications;

(d) to provide an abdominal exercise device that can be used with relative safety by pregnant women, those people with abdominal aneurysms, or those with certain types of hernias, without the potential hazards of considerable externally applied pressure on the abdomen;

Relative to Method of Use (e) to provide an abdominal exercise device that can be used to help correct hyperlordotic low backs ("sway backs") or hypolordotic low backs ("flat backs"), depending on how the device is utilized;

(f) to provide an abdominal exercise device that can be used in a variety of convenient postures, including sitting, standing or lying;

(g) to provide an abdominal exercise device that can stimulate the internal organs of the abdomen by increasing their blood flow;

(h) to provide an abdominal exercise device that can be utilized without the inconvenience or chafing associated with body-attached devices;

(i) to provide an abdominal exercise device that can mobilize the lumbar spine in a generally forward and backward direction, so as to improve the health of this region via increased nutrient flow;

(j) to provide an abdominal exercise device that utilizes a removable resistance measuring gauge, which allows the user, when desired, to monitor both progress and effort;

(k) to provide an abdominal exercise device that can produce direct and specific abdominal toning, whether it is utilized in contact with the abdomen or utilized in contact with the low back;

(l) to provide an abdominal exercise device that offers the user a choice in location of application, depending on whether the user prefers abdominal or low back contact when exercising the abdominal muscles;

Relative to a Central Recess (m) to provide an abdominal exercise device that has a central recess in one of its surfaces, sufficient to comfortably receive the user's fingertips, thereby providing a convenient gripping surface and eliminating the need for either a belt-attached device or a more costly handgrip mechanism;

(n) to provide an abdominal exercise device that has a central recess in one of its surfaces, sufficient to comfortably receive the bony protuberances of the user's spine when used against the low back, thereby minimizing spinal irritation and eliminating the need for a separate cushioning mechanism;

Relative to a Hinged Form (o) to provide an abdominal exercise device that has one surface pivotally connected by a hinge to another surface, so that when such a configuration is directly applied to the low back, it is better adapted for receiving the changing curve of the low back as this curve flattens during contraction of the abdominal muscles, than is a similar device employing parallel-facing surfaces;

(p) to provide an abdominal exercise device that has one surface pivotally connected by a hinge to another surface, so that when such a configuration is directly applied to the low back, it is easier to secure in a fixed position while exercising, than is a similar device employing parallel-facing surfaces;

(q) to provide an abdominal exercise device that has one surface pivotally connected by a hinge to another surface, so that when such a configuration is directly applied to the abdominal region, there is, by the inherent nature of the hinge-like pivot, less opportunity for aberrant movement during use, than is present in a similar device employing parallel-facing surfaces;

(r) to provide an abdominal exercise device that has one surface pivotally connected by a hinge to another surface, since such a configuration requires less material to construct than does a similar devices employing parallel-facing surfaces;

(s) to provide an abdominal exercise device that has one surface pivotally connected by a hinge to another surface, since such a configuration enables the device to be easily folded down by the user to a smaller form, unlike a similar device employing parallel-facing surfaces;

Relative to Size (t) to provide an abdominal exercise device that is small enough to be used on a variety of specific regions of the abdomen, so as to selectively isolate certain muscle groups and thereby maximize the user's efforts;

(u) to provide an abdominal exercise device that is small enough to be comfortably positioned behind the low back curvature when exercising the abdominal muscles;

(v) to provide an abdominal exercise device that is easily transported from one place to another due to its light weight and small size;

(w) to provide an abdominal exercise device that is collapsible to a size that allows it to fit in a coat pocket; and (x) to provide an abdominal exercise device that is economical to produce and is therefore affordable to a great number of people.

Still further objects and advantages of my invention will become apparent from a consideration of the ensuing description and drawings.

DESCRIPTION OF THE DRAWING FIGURES

FIG. 10 shows a perspective view of an alternative embodiment of this exercise device in operation with the direction of force shown by arrow Y.

FIG. 11 shows a perspective view of this device and the operational hand position of the embodiment shown in FIG. 10.

FIG. 12 shows a perspective view of the embodiment shown in FIG. 11 with the spring member under compression and the gauge in operation.

REFERENCE NUMERALS IN DRAWINGS

20—abdominal exercise device
30—clamshell-like body
40—spring member
50—resistance measuring gauge
60—base member
70—outer member
80—hinge member
88—external surface
90—internal surface
92—front wall
94*a* and *b*—side walls
96*a* and *b*—rib supports
98*a* and *b*—rib supports
100*a* and *b*—lateral walls
102—rear wall
104—spring clamp
106*a* and *b*—spring guides
108—gauge holder
110—gauge retaining recess
112—gauge retaining recess
114*a* and *b*—male fastening device
116—anchoring recess
120—centrally contoured external surface
122—centrally contoured internal surface
124—nonpivotal end wall
126*a* and *b*—side walls
128—gauge passage hole
132—concave recess
134—outer member pivotal end
136*a* and *b*—flat portions
142*a* and *b*—rib supports
144—cross member
146—central spring guide
152*a* and *b*—spring guide
154*a* and *b*—protuberances
156—lip
158*a* and *b*—female fastening device
160—base member pivotal end
170—hinge wall
172—narrow web
174—narrow web
180—upper flat surface
182—non-anchoring end
184—anchoring end

DESCRIPTION OF THE PREFERRED EMBODIMENTS—FIGS. 1-7

Figure 1:
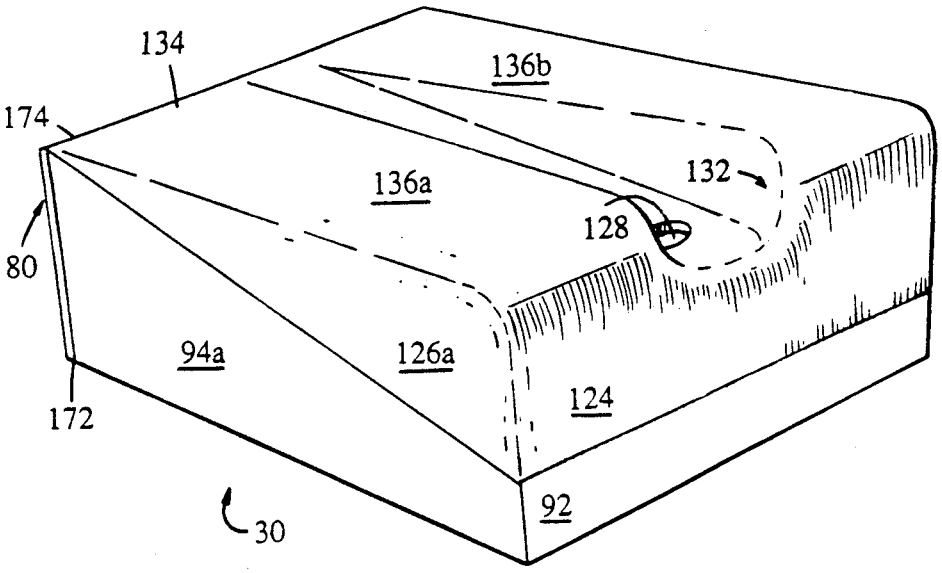
FIG. 1 shows a perspective view of an abdominal exercise device according to my invention in a non-operational or closed position.
Figure 2:
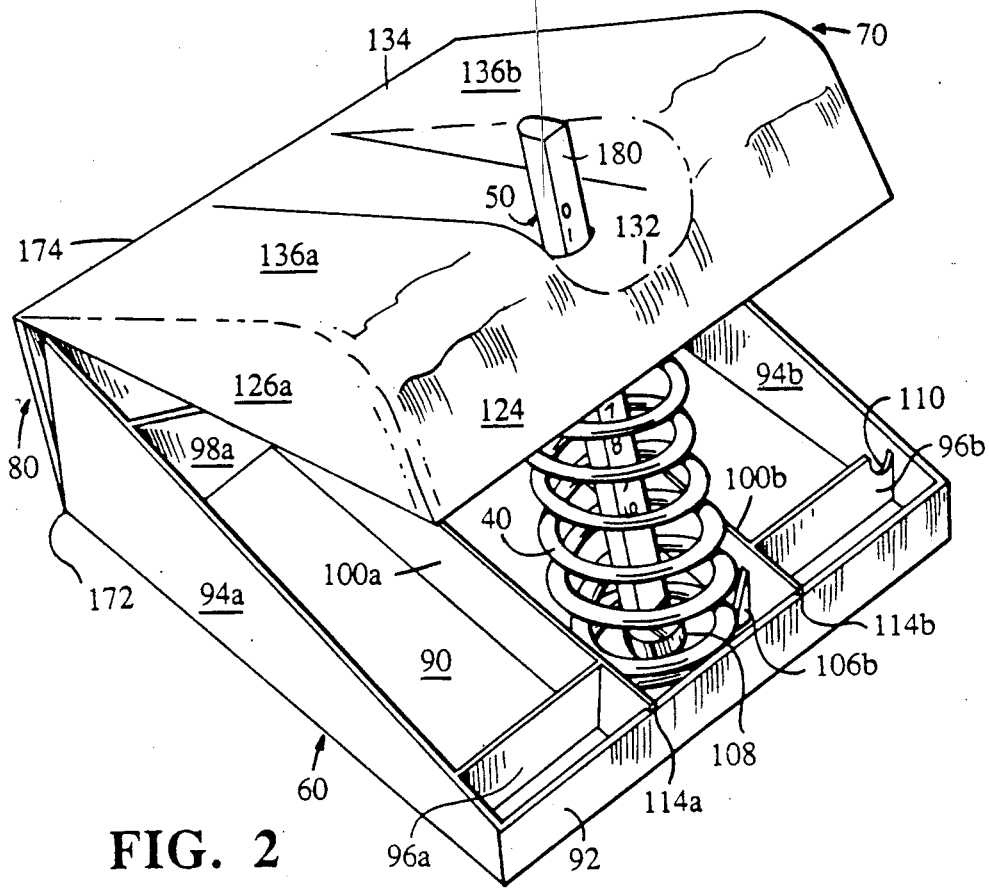
FIG. 2 shows a perspective view of this device in its resting operational position.
Figure 3:
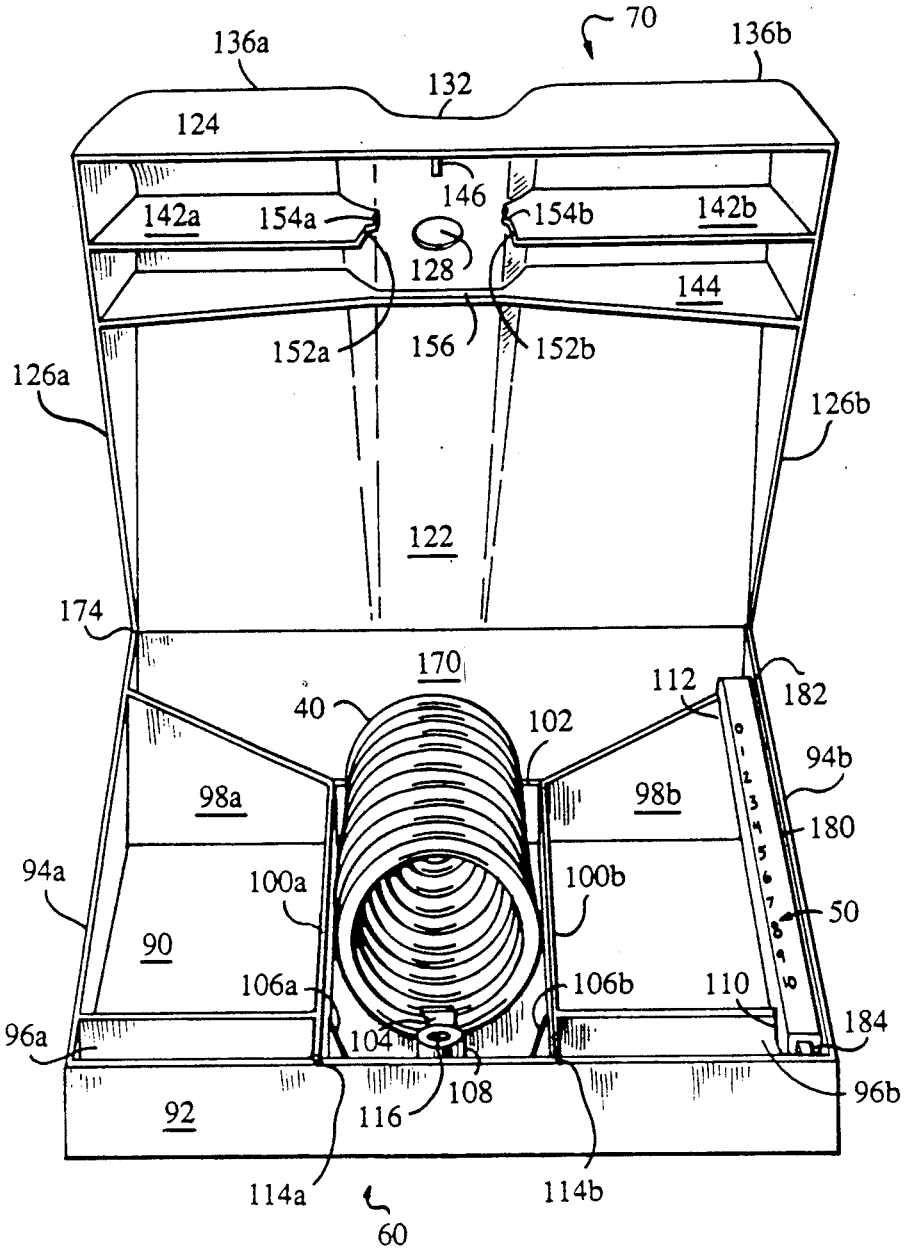
FIG. 3 shows a perspective view of several internal surfaces of this device with an external member opened and a spring member in a retained position.

FIGS. 1, 2 and 3 show one embodiment of an abdominal exercise device 20 according to a preferred embodiment of the invention. Device 20 is comprised of a clamshell-like body 30, a spring member 40 and a resistance measuring gauge 50.

Body 30 of the exercise device is illustrated as comprising a unitary structure of a relatively consistent thickness of injected molded plastic, such as polypropylene or any other suitable equivalent, exhibiting varying degrees of flexibility and rigidity at integral sites of its unitary design. The variances in flexibility are due to the physical properties of the injection molded plastic in relationship to the inherent design of the apparatus. Of course, other types of construction materials may be used.

Figure 5:
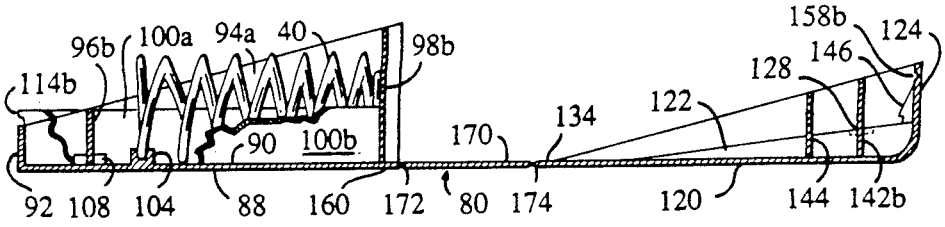
FIG. 5 shows a side view of the device in a fully opened, partially fragmented view, with the side walls taken away on one side and with the gauge removed.

As best shown in FIGS. 2 and 5, body 30 is further comprised of a base member 60, a outer member 70 and a hinge member 80. Hinge member 80 spans the pivotal end of base member 60 and outer member 70.

Base member 60 is comprised of a external surface 88, a internal surface 90, a front wall 92, and side walls 94*a* and 94*b*, as depicted in FIGS. 2 and 5.

Outer surface 88 of base member 60 is only shown in FIG. 5 and this view is from the side. Outer surface 88 is generally rectangular and flat. A cushioning surface, such as a thin layer of dense foam rubber, vinyl, felt or other resilient material, may be applied to external surface 88 as a protective layer.

Inner Surface

Inner surface 90 is at the opposite side of external surface 88 and contains a variety of generally perpendicular structures interrupting its otherwise flat contour, as shown in FIGS. 2, 3, and 5. The structures of internal surface 90 include: rib supports 96*a*, 96*b*, 98*a*, and 98*b*; a spring retaining enclosure comprising two lateral walls 100*a* and 100*b*, and a rear wall 102; a spring clamp 104; spring guides 106*a* and 106*b*; and a gauge holder 108.

Figure 4:
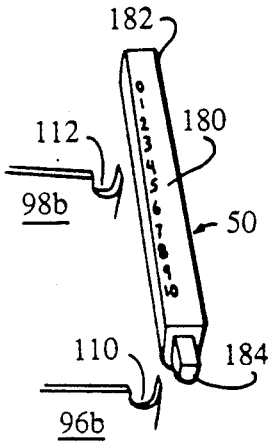
FIG. 4 shows a perspective view of a gauge used in this device with the gauge positioned above its retaining recess.

The top of rib supports 96*a* and 98*a* both begin flush at the top of side wall 94*a*, then follow a linear path so as to meet the top of lateral wall 100*a*, each forming a planar structure continuous with internal surface 90 and the respective portion of side wall 94*a*. Rib supports 96*b* and 98*b* are mirror images of their opposite side counterparts, except for a gauge retaining recess 110 and 112 in rib supports 96*b* and 98*b*, respectively, just adjacent to side wall 94*b*. Recesses 110 and 112 are adapted so as to receive gauge 50 when it is placed in its storage position, as shown in FIGS. 3 and 4.

Figure 7:
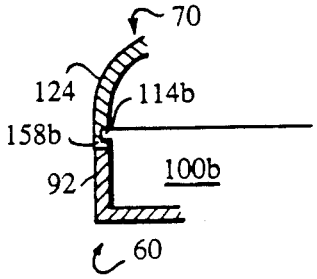
FIG. 7 shows a fragmented, cross-sectional view taken at a longitudinal cut through a region just outside the lateral wall of one pair of fasteners used in the device.

As shown in FIGS. 2, 3, and 5, the spring retaining enclosure has two lateral walls 100*a* and 100*b* that are approximately one-half the diameter of spring member 40 in height, and span the distance between front wall 92 and rear wall 102. Lateral walls 100*a* and 100*b* and rear wall 102 not only aid in restraining the spring member 40 but, in conjunction with rib supports 96*a*, 96*b*, 98*a* and 98*b*, add structural support to base member 60. Of course, additional rib supports may be used for supplemental stability. Lateral walls 100*a* and 100*b* contain a male fastening device 114*a* and 114*b*, respectively, as best depicted in FIG. 7. Fastening devices 114*a* and 114*b* serve to help lock base member 60 to outer member 70 when the exercise device is in a closed position as shown in FIG. 1, as will be detailed later.

Spring Clamp

Figure 6:
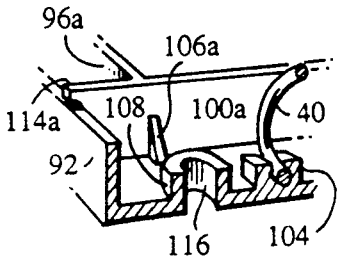
FIG. 6 shows a fragmented, cross-sectional view taken at a longitudinal cut through the midline of gauge holder and spring clamp used in the device.

Spring clamp 104, when viewed from the side as in FIG. 5 and 6, has a generally U-shaped configuration. Clamp 104 has sufficient depth, strength and resiliency to allow spring member 40 to perform several functions. Clamp 104 allows spring member 40 to pivot from the position shown in FIG. 3 to that shown in FIG. 2. Clamp 104 also allows spring member 40 to be safely secured to base member 60 without the need of additional fasteners. Furthermore, clamp 104 allows spring member 40 to be removed and replaced with springs of different resistances, if desired.

Spring guides 106*a* and 106*b* are relatively small triangular structures that appear as continuations of rib supports 96*a* and 96*b*, respectively, as shown in FIGS. 3 and 6.

FIGS. 2, 3, 5, and 6 show how gauge holder 108 arises from internal surface 90 of base member 60 between front wall 92 and spring clamp 104. Gauge holder 108 contains a centrally placed anchoring recess 116 that is adapted to secure gauge 50 when this embodiment is in operation. A more complete description of gauge 50 will be provided later.

Front wall 92 is perpendicularly connected at each end to side walls 94*a* and 94*b*, forming a continuous perpendicular enclosure around three sides of the perimeter of internal surface 90 of base member 60, as illustrated in FIGS. 2, 3 and 5. The height of front wall 92 is slightly lower than one-half the diameter of spring member 40. The top of side walls 94*a* and 94*b* begin flush with the top of the front wall 92 and each spans the distance to a point just adjacent to the beginning of hinge member 80. Side walls 94*a* and 94*b* incline upward to a final height equal to the height of the tallest part of the upright hinge member 80, as depicted in FIG. 1. Walls 92, 94*a*, and 94*b* in the configuration shown in FIG. 3 were found to provide easy access by the user to spring member 40 and gauge 50, but other wall configurations may be utilized.

Outer Member

FIGS. 2, 3, and 5 show that outer member 70 is comprised of a centrally contoured external surface 120, a centrally contoured internal surface 122, a nonpivotal end wall 124, side walls 126*a* and 126*b*, and a gauge passage hole 128.

Figure 9:
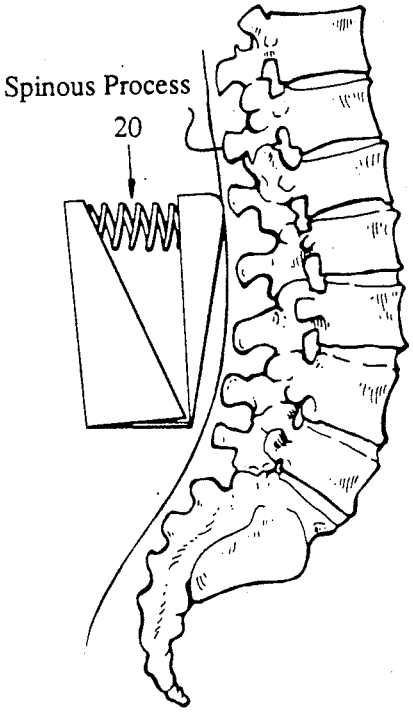
FIG. 9 shows a somewhat diagrammatic side view, partially in section, illustrating the relationship of this device to the lower spine and the spinous processes, as used in FIG. 8.

Centrally contoured external surface 120 has a generally concave recess 132 of sufficient depth and width to receive the bony protuberances of a user's spine, known as the spinous processes, as shown in FIG. 9. Furthermore, concave recess 132 also has sufficient depth and width to receive the user's fingertips, when utilized as shown in FIGS. 10, 11 and 12. Concave recess 132 eliminates the need for belt attachments, handgrips, and for a separate spinal cushioning mechanism.

As best shown in FIG. 2, concave recess 132 begins and is deepest at the end adjacent to nonpivotal end wall 12. Concave recess 132 spans most of the length of external surface 120, but gradually diminishes in depth until it is flush with the surface at outer member pivotal end 134. The upper edges of the concave recess 132 blend in a rounded manner with flat portions 136*a* and 136*b*. Flat portions 136*a* and 136*b* are symmetrical and each comprise approximately one-third the total width of outer member 70. When the exerciser is in the nonoperational or closed position shown in FIG. 1, flat portions 136*a* and 136*b* are generally parallel to external surface 88 of base member 60.

Centrally Contoured Inner Surface

FIGS. 3 and 5 show that centrally contoured internal surface 122 has a generally convex central recess and contains several generally perpendicular arising structures. The structures of internal surface 122 include rib supports 142*a* and 142*b*, cross member 144, and a central spring guide 146.

Rib supports 142*a* and 142*b* each begin flush with the top of their respective side walls 126*a* and 126*b*, and span the distance to their respective spring guides 152*a* and 152*b*. Rib supports 142*a* and 142*b* form a planar structure continuous with their respective side walls 126*a* and 126*b* and the internal surface 122. Spring guides 152*a* and 152*b* of each rib support 142*a* and 142*b* are angled so as to assist the spring member 40 into proper position when the user places spring member 40 in an operational position. Spring guides 152*a* and 152*b* each contain a protuberance 154*a* and 154*b*. Protuberances 154*a* and 154*b* serve to anchor spring member 40 when it is in an operational position. Naturally, additional anchoring devices may be utilized.

Cross member 144 is one continuous support that begins flush at the top of side walls 126*a* and 126*b*. Cross member 144 continuously spans the distance between side walls 126*a* and 126*b* and is continuously connected on one edge to internal surface 122. Cross member 144 tapers symmetrically in the central section of internal surface 122, forming a relatively small lip 156. The central spring guide 146 is a relatively small structure that arises from the midline of centrally contoured internal surface 122 and angles toward the inner surface of nonpivotal end wall 124. Central spring guide 146 serves to help guide spring member 40 into its proper operational position.

Nonpivotal End Wall

Nonpivotal end wall 124 is somewhat perpendicularly connected at each end to side walls 126*a* and 126*b*, forming a continuous, somewhat perpendicular enclosure around three edges of the perimeter of centrally contoured internal surface 122 of outer member 70. The height of the outer side of nonpivotal end wall 124 is larger than front wall 92. Nonpivotal end wall 124 blends in a rounded fashion with flat portions 136*a* and 136*b*. The distance from end wall 124 to hinge member 80 is spanned by a generally decreasing height of side walls 126*a* and 126*b*.

FIG. 7 shows that the inner surface of nonpivotal end wall 124 contains two female fastening devices 158*a* and 158*b*, which are sufficiently deep to receive male fastening device 114*a* and 114*b*, respectively. When respective male and female fastening devices 114*a*, 114*b*, 158*a* and 158*b* are joined together, body 30 case can be secured in a closed position as shown in FIG. 1.

Gauge passage hole 128 in outer member 70 is shown as circular in shape, and is centrally placed on a line that passes through rib supports 142*a* and 142*b*, as depicted in FIG. 3. Gauge device passage hole 128 is sufficiently large enough so as to easily allow gauge 50 to be placed through it and then anchored in gauge holder 108.

Hinge Member

FIGS. 1, 2, and 5 show that hinge member 80 spans the distance between base member pivotal end 160 and outer member pivotal end 134. The exerciser is depicted as having a dual-pivoting, living (integral) hinge comprised of a hinge wall 170, and two narrow webs 172 and 174. Narrow webs 172 and 174 allow outer member 70 to flexibly open and close with respect to base member 60. This webbing is also a product of the previously described injected molding process. The advantages of this type of hinge method is that it is relatively inexpensive compared to add-on hinges and it is easy to manufacture. Of course, a separate add-on hinge or hinges may be used, especially if more sophisticated versions of the exerciser are manufactured. Additionally, a single-pivoting hinge may be utilized by having side walls 94*a* and 94*b* fastened to, or molded as a continuation of, hinge wall 170. A hinged form has several advantages over a similar device employing parallel-facing surfaces, including better adaptation to the changing curvature of the low back as it flattens, greater stability, less construction materials, and easier collapsibility.

Spring member 40 is a coiled steel spring with a maximum resistance of approximately 30 kilograms.

Referring to FIGS. 3 and 4, Gauge 50 is composed of plastic in this embodiment, but wood or metal may also be used. Gauge 50 has sequential markings, such as the integers 0 to 10, on a upper flat surface 180. An anchoring end 184 is adapted so as to snugly fit in anchoring recess 116 of gauge holder 108, after having been placed through gauge passage hole 128, as shown in FIG. 2.

Other Embodiments

In another embodiment of this abdominal exercise device 20, which is not depicted by illustration, all structures are analogous to the embodiment already described except that there is not gauge 50 or gauge associated parts. Thus, the alternative embodiment does not contain gauge 50, gauge holder 108, and its anchoring recess 116, gauge retaining recesses 110 and 112, and gauge passage hole 128. All other structures are identical to the original embodiment as previously described.

The basic dimensions of the embodiments described above are analogous. Clamshell-like body 30 of FIG. 1 is best adapted to the typical user if it is approximately 11.5 centimeters in length, 10 centimeters in width, and 4.5 centimeters in height. Additionally, when spring 40 is somewhat perpendicularly disposed between base member 60 and outer member 70, as shown in FIG. 2, the angle formed between their respective external surfaces is approximately 40 degrees. While various other dimensions are satisfactory for widespread use, the minimum length is approximately eight centimeters. To utilize a shorter length than 8 centimeters results in a device that is too unstable to use effectively. The maximum effective length is approximately 15 centimeters. Beyond this length, the device fails to adequately adapt to the abdomen and/or low back of some of the smaller users.

OPERATION—FIGS. 8-12

To use this device, the user unlocks body 30 by gently dislodging male fastening device 114*a* and 114*b* from female fastening device 158*a* and 158*b*, as depicted in the secured position shown in FIG. 7. The user then opens body 30 by separating front wall 92 of base member 60 from nonpivotal end wall 124 of outer member 70. As shown in FIG. 3, outer member 70 is opened sufficiently so the unclamped end of spring member 40 can be lifted from its nonworking position in the spring retention enclosure comprised of two lateral walls 100*a* and 100*b*, and rear wall 102.

Figure 8:
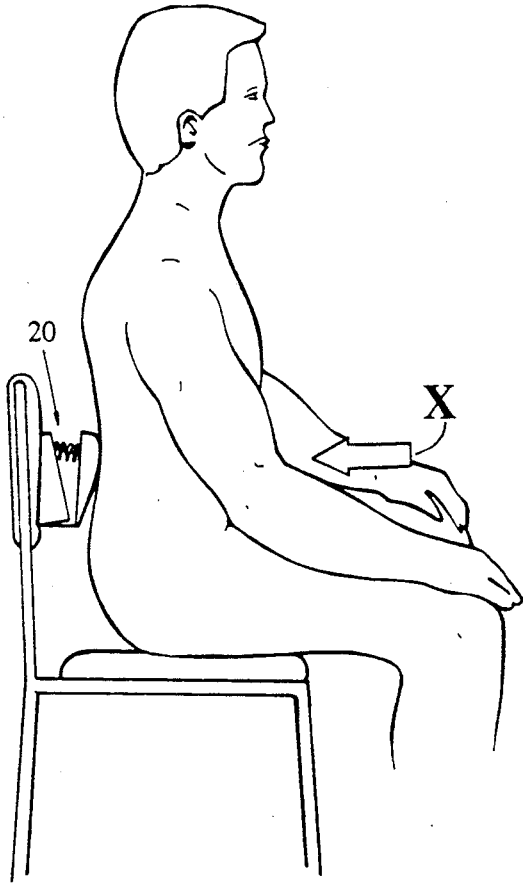
FIG. 8 shows a side elevation view of one embodiment of this device in operation with the direction of force shown by arrow X.

Spring member 40 is then elevated to a position of somewhat less than 90 degrees to internal surface 90 of base member 60. Outer member 70 is then brought down to a point where spring guides 146, 152*a*, and 152*b* can direct spring member 40 into a position where it is secured by protuberances 154*a* and 154*b*. The exerciser is then considered in a resting operational position when spring member 40 is securely disposed between outer member 70 and base member 60, at an angle of somewhat less than 90 degrees, as shown in FIGS. 8 and 9. In the resting operational position, the exerciser has a generally V-shaped opening at the nonpivotal end.

Abdominal Exercise When Device is Placed Behind the Low Back

When the abdominal muscles are exercised with the exerciser placed behind the user's back, gauge 50 is not needed and may be left in gauge retaining recesses 110 and 112, as shown in FIG. 3. With the user either seated in a chair or standing with his or her back to the wall, the exerciser is placed behind the low back, as depicted in FIG. 8. The user takes care so as to place the bony protuberances of his or her spine, known as the spinous processes, into concave recess 132 so as to protect these often tender and easily irritated areas. FIG. 9 shows these spinous processes in relationship to device 20.

The user then pulls the abdomen inward, toward the spine, in the direction depicted by arrow X of FIG. 8. This inward contraction of user's abdominal muscles forces the low back curvature to flatten. The more the user contracts the abdominal muscles, the more the open edges of outer member 70 and base member 60 are forced together, against the resistance of spring member 40. The user then slowly lets the abdominal muscles relax, and spring member 40 decompresses as outer member 70 and base member 60 move apart. As a result of the user relaxing his or her abdominal muscles, the low back curvature returns to the starting lordotic position shown in FIGS. 8 and 9.

The movement from the starting position to full contraction, back to the original starting position, constitutes one repetition with this exercise device as used in the operational description above. Difficulty can be added by doing successively more and more repetitions, or by holding the maximum contraction portion of the exercise for longer periods of time. The compression range of the spring member 40 is such that it can accommodate up to approximately 30 kilograms compression, which has proven in my experimentation to be sufficient to tone the abdominal muscles of almost any user.

Use with "Sway Backs" and Safety Considerations

If user has a hyperlordotic or "sway back," the utilization of this device as described above can serve to decrease this excessive curvature through progressive strengthening and biomechanical retraining. Also, this method involves so few other muscles, unlike sit-up exercises, that less total effort is required to perform the abdominal workout. This repeated inward contraction of the abdominal muscles also serves to stimulate blood flow to the digestive organs, thereby improving their health. Exercising the abdomen as described above is relatively safe for most people. Such a method is probably safer than other abdominal exercise means for most pregnant women and those with abdominal aneurysms or certain hernias.

Naturally, before undertaking any course of exercise, one should obtain approval from his or her primary health care provider. If pain or physiological abnormalities should develop when using this device, in any fashion, then its use should be immediately discontinued and a primary health care provider should be consulted.

Direct Application to the Abdomen

FIG. 10 shows that the exerciser can also be used to work out the abdominal muscles when directly applied to the abdominal region, rather than directly applied to the low back.

As with the prior method of operation, the user should place the device in the resting operational position. This position requires that the non-clamped end of spring member 40 be secured in an upright position and the opposite end of spring member 40 be secured to outer member 70, as was previously described. In the resting operational position, the exerciser has a generally V-shaped opening at the nonpivotal end.

The user then places exerciser against the abdomen as shown in FIG. 10. In this position, the user secures the device as shown in FIGS. 11 and 12, by grasping it with each hand and placing the fingertips into concave recess 132. With external surface 88 of base member 60 squarely against the abdomen, the user draws in the abdomen as much as possible and pushes the abdomen outward against the resistance of spring member 40, as shown by arrow Y in FIG. 9. Care is taken to make sure that outer member 70 is held in one fixed position and that the abdominal muscles are used to push base member 60 closer to outer member 70. When the exercise is properly performed, the edge of the abdomen contacting the exerciser will travel no more than approximately six centimeters outward. Six centimeters is the approximate maximum range of motion allowed by the exerciser, and represents the approximate distance between the internal edge of nonpivotal end wall 124 and the inner edge of front wall 92, as shown in FIG. 2.

Once an outward push of the abdomen has been made as described above, the user slowly relaxes the abdominal muscles and allows the exerciser, via the resistance of spring member 40, to return to the abdomen-retracted starting position. This one cycle of motion constitutes one repetition. The intensity of the workout is increased by adding repetitions, by holding the outward contraction for a longer period of time, and by pushing the abdomen outward with greater force.

Use With and Without the Gauge

When utilized with the exerciser directly upon the abdomen, it can be used with or without gauge 50 in operation. When gauge 50 is utilized as shown in FIG. 2, it permits the user to visualize the relative degree of resistance being overcome by one's efforts, thus helping to monitor both progress and effort. When gauge 50 is not utilized, the method of operation is still essentially the same but the user has less objective means to measure resistance.

FIGS. 2, 11, and 12 show gauge 50 secured in a functional position after having its anchoring end 184 placed through resistance gauge passage hole 128 and into anchoring recess 116 of gauge holder 108. The user then begins exercising in the same manner as described above when gauge 50 was not in its functional position. The numerals on gauge 50 are observed as they move past the edge of passage hole 128 when the user exercises so as to compress and then decompress spring member 40, thus allowing an objective measure of the degree of resistance being utilized.

Because the exerciser requires virtually none of the torso motions associated with a standard sit-up, there are virtually none of the associated stresses placed upon the low back and neck structures. When directly applied to the abdomen, the exerciser can be used with equal effectiveness in a variety of postures, including sitting, standing or lying. The exerciser can, by virtue of its relatively small contact area, also be used on a variety of abdominal or low back locations. This ability allows the user to selectively isolate certain abdominal muscle groups and avoid stressing unrelated muscles groups, such as the hip flexor muscles. The ability to use the device either directly on the low back or directly on the abdominal region, provides an added dimension of choice to the user not found in any other abdominal exerciser.

When the user utilizes the device as shown in FIG. 10, the lumbar spine can be made to increase its resting curvature or lordosis. Thus, those persons with a hypolordotic or "flat back" can exercise with this device in a manner consistent with the correction of their condition. When utilized as in both FIG. 8 and FIG. 10, the lumbar vertebrae can be gently made to move in a generally forward bending and then backward bending direction, which is known to increase fluid and nutrient flow to these structures.

When Finished Exercising

When the user is finished exercising with the device, it can be left in its resting operational position or returned to its closed position as shown in FIG. 1, by reversing the steps that brought it to an operational position. In this closed configuration, the exercise device can easily be transported and will even fit inside a standard size coat pocket.

This exercise device requires a relatively small amount of light weight and readily available materials in order to construct, and thus can be made and distributed at a cost readily affordable to most people.

As described earlier, one alternative preferred embodiment of this exerciser utilizes no gauge 50 or gauge associated parts. The operation of this alternative embodiment is identical to the operations described above, except that there is no means to objectively measure the relative resistance. Thus, any operational steps associated with gauge 50, gauge holder 108 and its anchoring recess 116, gauge recesses 110 and 112, and gauge passage hole 128 are eliminated.

CONCLUSION, RAMIFICATIONS, AND SCOPE OF INVENTION

Accordingly, the reader will see that this abdominal exerciser can be utilized to firm and flatten the abdominal muscles with relative ease, safety and convenience. The muscles of the abdomen can be directly exercised with the device placed either directly on the abdomen or directly on the low back, depending on individual preference as to comfort, health condition or desired effect on the low back curvature. The device's hinged configuration is well adapted for engaging the user's low back curvature throughout the movement of the exercise, provides added stability during operation, and offers rapid collapsibility. The device can be used in a variety of postures, including sitting, standing and lying. Its measuring gauge makes it possible to monitor both effort and progress in the pursuit of increased abdominal strength, thereby helping to motivate the user toward continued use. Additional motivation to use the device comes from the fact that the exerciser can be made to fit in a coat pocket, assuring that it can be carried with the user to almost any location. The simplicity of the construction of this device and the availability of materials assures availability at a relatively low consumer cost.

Although the above description contains many specificities, these should not be interpreted as limiting the scope of this invention but merely as providing exemplification of two of the presently preferred embodiments of this invention. For example, this invention could be made of different materials, such as metals, composites, etc.; contain springs of varying numbers, compression resistances, shapes, etc.; utilize hinges of a standard nature, with a single-pivot or dual-pivot action; provide a cushioning layer on external surface 88 and/or external surface 120, composed of rubber, felt, etc.; employ an additional contoured attachment that would fit in concave recess 132 and fill this gap so as to create a relatively flat surface, thereby making it possible to comfortably use this device for exercising the arms, chest, thighs, etc.

Thus, the scope of this invention should be determined not by the embodiments illustrated, but by the appended claims and their legal equivalents.

I claim:

1. A method for enabling a user to directly exercise his or her abdominal muscles, comprising the following steps:

providing an exercise device comprising a base member adapted to engage a stable surface, an outer member adapted to be applied against said user's low back, a hinge means pivotally connecting said members, and a resilient means disposed between said members and positioned so as to urge said members apart, such that said members form a generally V-shaped opening when so urged apart, said base member and said outer member each having an internal surface, an external surface, a pivotal end, and a nonpivotal end, and said outer member having a central contour of sufficient recess to receive the bony protuberances of said user's spine, and with said recess extending longitudinally on said outer member, being deepest on said non-pivotal end and gradually diminishing in depth, becoming flush with said outer member and, placing said external surface of said base member against said stable surface, and said external surface of said outer member against user's low back, and exercising one's abdominal muscles by pulling these muscles inward so as to force one's low back to push said base member and said outer member together against the resistance of said resilient means, then relaxing one's abdominal muscles so as to let said members move apart, and repeating said last two steps so as to cause said members to repeatedly move together and apart, thereby exercising one's abdomen by a direct retraction movement of one's abdominal muscles.

2. The method of exercising one's abdominal muscles of claim 1 wherein said members each have side walls, said nonpivotal ends of said members each has a single wall joining their respective said side walls, and said pivotal ends of each of said members share a common wall.

3. The method of exercising one's abdominal muscles of claim 1 wherein said members and hinge means are formed into one single, continuous piece of molded plastic, and said hinge means is a living hinge with at least one pivotal connection.

4. The method of exercising one's abdominal muscles of claim 1 wherein said resilient means is a coiled spring.

5. The method of exercising one's abdominal muscles of claim 1 further including a clamp for securing said resilient means to said internal surface of said base member, thereby allowing said resilient means to be moved by said user from a working position where said resilient means is disposed between said members to a nonworking position where said resilient means is substantially parallel to said base member.

6. The method of exercising one's abdominal muscles of claim 1 wherein said hinge means is arranged to allow said outer member to pivot to a closed position which is substantially parallel to said base member, provided said resilient means is moved by said user to said nonworking position.

7. The method of exercising one's abdominal muscles of claim 1 further including a fastening means comprising at least one protuberance on one member and at least one recess adapted to receive said protuberance on opposite said member, thereby to be able to hold said members in said closed position.

8. The method of exercising one's abdominal muscles of claim 1 wherein said members and said hinge means form a clamshell-like body, said clamshell-like body, when in said closed position, being approximately 11.5 centimeters in length, 10 centimeters in width, and 4.5 centimeters in height.

9. The method of exercising one's abdominal muscles of claim 1 further including a cushioning means on at least one of said external surfaces of said members.

10. A method for enabling a user to directly exercise his or her abdominal muscles, comprising the following steps:

providing an exercise device comprising a base member adapted to be applied against said user's abdomen, an outer member adapted to engage the fingertips of both hands of said user, and a hinge means pivotally connecting said members, and a resilient means disposed between said members and positioned so as to urge said members apart, such that said members form a generally V-shaped opening when so urged apart, said base member and said outer member each having an internal surface, an external surface, a pivotal end, and a nonpivotal end, and said outer member having a central contour of sufficient recess to receive the fingertips of both hands of said user, and with said recess extending longitudinally on said outer member, being deepest on said non-pivotal end and gradually diminishing in depth, becoming flush with said outer member and, placing said external surface of said base member against said user's abdomen and holding said outer member in a relatively fixed position by user's gripping action of at least one hand, and exercising one's abdominal muscles by forcing these muscles outward so as to force one's abdomen to push said outer member and said base member together against the resistance of said resilient means, then relaxing one's abdominal muscles so as to allow said members to move apart, and repeating said last two steps so as to cause said members to repeatedly move together and apart, thereby exercising one's abdomen by a direct protrusion movement of one's abdominal muscles.

11. The method of exercising one's abdominal muscles of claim 10 wherein said members each have side walls, said nonpivotal ends of said members each has a single wall joining their respective said side walls, and said pivotal ends of each of said members share a common wall.

12. The method of exercising one's abdominal muscles of claim 10 wherein said members and hinge means are formed into a single, continuous piece of molded plastic, and said hinge means is a living hinge with at least one pivotal connection.

13. The method of exercising one's abdominal muscles of claim 10 wherein said resilient means is a coiled spring.

14. The method of exercising one's abdominal muscles of claim 10 further including a clamp for securing said resilient means to said internal surface of said base member, thereby allowing said resilient means to be moved by said user from a working position where said resilient means is disposed between said members to a nonworking position where said resilient means is substantially parallel to said base member, and when said resilient means is in said nonworking position, said outer member can be moved by said user to a closed position which is substantially parallel to said base member.

15. The method of exercising one's abdominal muscles of claim 10 further including a fastening means comprising at least one protuberance on one member and at least one recess adapted to receive said protuberance on opposite said member, thereby to be able to hold said members in said closed position.

16. The method of exercising one's abdominal muscles of claim 10 further including a hole in said outer member, a detachable measuring gauge, and a gauge holding means positioned to hold said gauge as one end of said gauge moves through said hole when said members are forced together by said user, thereby to allow one to measure the relative degree of resistance overcome by said user during said method of abdominal exercise by observing a scale on said gauge as said outer member is moved along said scale.

17. The method of exercising one's abdominal muscles of claim 10 wherein said members and said hinge means form a clamshell-like body, and said clamshell-like body, when in said closed position, is approximately 11.5 centimeters in length, 10 centimeters in width, and 4.5 centimeters in height.

18. The method of exercising one's abdominal muscles of claim 10 further including a cushioning means on at least one of said external surfaces of said members.

19. A method for enabling a user to directly exercise his or her abdominal muscles, comprising the following steps:

providing an exercise device comprising a base member adapted to be applied against said user's abdomen, an outer member adapted to engage the fingertips of both hands of said user, and a hinge means pivotally connecting said members, and a resilient means disposed between said members and positioned so as to urge said members apart, such that said members form a generally V-shaped opening when so urged apart, said base member and said outer member each having an internal surface, an external surface, a pivotal end, and a nonpivotal end, and said outer member having a central contour of sufficient recess to receive the fingertips of both hands of said user, and placing said external surface of said base member against said user's abdomen and holding said outer member in a relatively fixed position by user's gripping action of at least one hand, and exercising one's abdominal muscles by forcing these muscles outward so as to force one's abdomen to push said outer member and said base member together against the resistance of said resilient means, then relaxing one's abdominal muscles so as to allow said members to move apart, and repeating said last two steps so as to cause said members to repeatedly move together and apart, thereby exercising one's abdomen by a direct protrusion movement of one's abdominal muscles, and further including a hole in said outer member, a detachable measuring gauge, and a gauge holding means positioned to hold said gauge as one end of said gauge moves through said hole when said members are forced together by said user, thereby to allow one to measure the relative degree of resistance overcome by said user during said method of abdominal exercise by observing a scale on said gauge as said outer member is moved along said scale.

* * * * *